US011939768B1

(12) United States Patent
Liu et al.

(10) Patent No.: US 11,939,768 B1
(45) Date of Patent: Mar. 26, 2024

(54) SLEEVE GROUTING DEVICE AND METHOD FOR PREFABRICATED BUILDING

(71) Applicant: CCCC CONSTRUCTION GROUP CO., LTD., Beijing (CN)

(72) Inventors: Wenchao Liu, Beijing (CN); Kesheng Zhang, Beijing (CN); Baoshuang Ren, Beijing (CN); Shuwei Cheng, Beijing (CN)

(73) Assignee: CCCC CONSTRUCTION GROUP CO., LTD., Beijing (CN)

( * ) Notice: Subject to any disclaimer, the term of this patent is extended or adjusted under 35 U.S.C. 154(b) by 0 days.

(21) Appl. No.: 18/206,820

(22) Filed: Jun. 7, 2023

Related U.S. Application Data

(63) Continuation of application No. PCT/CN2022/134123, filed on Nov. 24, 2022.

(30) Foreign Application Priority Data

Sep. 14, 2022 (CN) ..... 202211115136.8

(51) Int. Cl.
*E04C 5/16* (2006.01)

(52) U.S. Cl.
CPC ..... *E04C 5/165* (2013.01)

(58) Field of Classification Search
CPC ..... E04C 5/162; E04C 5/163; E04C 5/165; E04G 21/08
See application file for complete search history.

(56) References Cited

U.S. PATENT DOCUMENTS 3,638,978 A * 2/1972 Guntermann ..... E04C 5/165 164/DIG. 12
5,974,761 A * 11/1999 Mochizuki ..... E04C 5/165 403/267

(Continued)

FOREIGN PATENT DOCUMENTS

CN 107389791 A 11/2017
CN 207197581 U 4/2018

(Continued)

OTHER PUBLICATIONS

Machine Translation for CN207197581, printed from Espacenet Nov. 29, 2023.*

(Continued)

*Primary Examiner* — Christine T Cajilig
(74) *Attorney, Agent, or Firm* — Cooper Legal Group, LLC

(57) ABSTRACT

Disclosed are a sleeve grouting device and method for prefabricated building, relating to the technical field of engineering construction. The grouting device includes a sleeve, a driver and an oscilloscope, sleeve openings at two ends of the sleeve each are configured to be penetrated by connection rebars of each of two different prefabricated components, a piezoelectric ceramic is provided horizontally at each of the sleeve openings at two ends of the sleeve, a corresponding one of the piezoelectric ceramics is electrically connected to the driver and another corresponding one of the piezoelectric ceramics is electrically connected to the oscilloscope; a bottom end of the sleeve is connected to an inlet pipe to be communicated with a g grout injection equipment, and a top end of the sleeve is connected to an outlet pipe.

8 Claims, 2 Drawing Sheets

(56) References Cited

U.S. PATENT DOCUMENTS

| | | | | |
|---|---|---|---|---|
| 6,581,343 | B1 * | 6/2003 | Metelli | E04B 7/022 52/583.1 |
| 2010/0101160 | A1 * | 4/2010 | Bongiorno | E04C 5/03 52/741.3 |
| 2014/0060721 | A1 * | 3/2014 | Hongo | E04C 5/00 156/71 |
| 2020/0232207 | A1 | 7/2020 | Zheng et al. | |

FOREIGN PATENT DOCUMENTS

| | | | |
|---|---|---|---|
| CN | 207419860 | U | 5/2018 |
| CN | 109991244 | A | 7/2019 |
| CN | 110455914 | A | 11/2019 |
| CN | 210767886 | U | 6/2020 |
| CN | 212104830 | U | 12/2020 |
| CN | 112964786 | A | 6/2021 |
| CN | 213509227 | U | 6/2021 |
| CN | 213952716 | U | 8/2021 |
| CN | 113624946 | A | 11/2021 |
| CN | 216587356 | U | 5/2022 |
| CN | 216658424 | U | 6/2022 |
| CN | 217352147 | U | 9/2022 |
| CN | 115749147 | A | 3/2023 |
| DE | 2231515 | A1 * | 1/1974 |
| JP | 2002030763 | A | 1/2002 |
| JP | 2019056286 | A | 4/2019 |

OTHER PUBLICATIONS

Machine Translation for CN207419860, printed from Espacenet Nov. 29, 2023.*

Machine Translation for CN212104830, printed from Espacenet Nov. 29, 2023.*

Machine Translation for CN110455914, printed from Espacenet Nov. 29, 2023.*

International Search Report of Corresponding Application No. PCT/CN2022/134123; dated Mar. 22, 2023; 5 Pgs.

* cited by examiner

SLEEVE GROUTING DEVICE AND METHOD FOR PREFABRICATED BUILDING

CROSS-REFERENCE TO RELATED APPLICATION

This application is a continuation of PCT application serial no. PCT/CN2022/134123, filed on Nov. 24, 2022, which claims the priority and benefit of Chinese patent application serial no. 202211115136.8, filed on Sep. 14, 2022. The entireties of PCT application serial no. PCT/CN2022/134123 and Chinese patent application serial no. 202211115136.8 are hereby incorporated by reference herein and made a part of this specification.

TECHNICAL FIELD

The present application relates to the technical field of engineering construction, and, in particular to a sleeve grouting device and method for prefabricated building.

BACKGROUND

Buildings through assembling of prefabricated components have been steadily developed with the attention of people and support of the state. The construction steps of a prefabricated building usually start with casting of individual components in the factory, and assembling after being transported to the site, thus enabling rapid construction of a building.

Among the technologies related to the assembled structural engineering of reinforced concrete, grouted sleeve connections are a common and versatile connection way. Connection rebars would be pre-buried in sides of two prefabricated components to be connected facing each other, which protrude out of the surfaces and are corresponding one to one. The corresponding connected rebars of the two prefabricated components are inserted in the sleeve from two ends thereof and high-strength concrete grout is injected in the sleeve, such that a stabilized connection would be realized after solidification of the concrete grout.

The full degree of the concrete grout in the connection structure of grouted sleeve directly affects the quality of the assembled concrete structure. If the grouted sleeve is not full of concrete grout and large bubble cavities are present, the expected force performance can't be realized in the connection structure, thus creating serious safety hazards.

In response to the above mentioned technology, it is found that bubble cavities often remain in the connection structure of the grouted sleeve, and the staff does not have a corresponding means to detect bubble cavities in the connection structure before solidification. Once multiple bubble cavities are connected to each other after cooling of the concrete, the force performance of the connection structure will be greatly affected, thus serious safety hazards are present in the connection structure. Therefore, the connection structure must be removed and reworked.

SUMMARY

In order to detect the concrete grout structure in the sleeve in real time, to discover the information about bubble cavities in the concrete grout in time and make timely adjustment to the connection structure, thereby improving connection stability of the connection structure of grouted sleeve and improving force performance of the connection structure, a sleeve grouting device and method for prefabricated building are disclosed.

In a first aspect, the following technical scheme is applied by the sleeve grouting device and method for prefabricated building disclosed. A sleeve grouting device for prefabricated building includes a sleeve, a driver and an oscilloscope, sleeve openings at two ends of the sleeve each are configured to be penetrated by connection rebars of each of two different prefabricated components, a piezoelectric ceramic is provided horizontally at each of the sleeve openings at two ends of the sleeve, a corresponding one of the piezoelectric ceramics is electrically connected to the driver and another corresponding one of the piezoelectric ceramics is electrically connected to the oscilloscope; a bottom end of the sleeve is connected to an inlet pipe to be communicated with a g grout injection equipment, and a top end of the sleeve is connected to an outlet pipe.

By the above technical solution, after the sleeve is filled with concrete grout with the grout injection equipment, the driver is turned on so that the corresponding piezoelectric ceramic generates a signal wave, and then the piezoelectric ceramic at the top end of the sleeve receives the signal wave, which is then displayed on the oscilloscope. The waveform displayed on the oscilloscope can be compared with the standard waveform in the full state. When a large difference appears in the waveform and period between the both, it can be determined that there is a relative large bubble cavity in the inner cavity of the sleeve. At this time the staff can continue to inject concrete grout into the sleeve, such that the grout with bubbles overflows from the outlet pipe and the sleeve can be filled with denser concrete grout, until full degree of the concrete grout between the two piezoelectric ceramics meets the requirements.

Optionally, the device further includes a vibrating assembly, the vibrating assembly includes a vibrator, a connection rod, and a connection tube, ends of the two of the connection rebars close to each other are all slidably connected in the connection tube, a vibrating tube is connected to the sleeve at a position of the sleeve corresponding to the connection tube, the connection tube is slidably connected in the vibrating tube, an end of the connection rod protrudes in the sleeve and is connected with the connection tube, and an end of the connection tube outside the sleeve is connected with the vibrator.

By the above technical solution, when the oscilloscope shows a large bubble cavity in the concrete grout in the sleeve, the vibrator is turned on, and vibration is transmitted to the two rebars inside the sleeve through the connection rod and in turn is transmitted to the concrete grout in the sleeve. The concrete grout will squeeze out the inner bubbles under influence of the vibration, thereby the concrete grout after solidification has a denser texture and the full degree of the concrete in the sleeve is improved, thus improving the connection stability of the connection structure.

Optionally, the vibrator includes a vibrating motor and a vibrating cylinder eccentrically fixed on an output shaft of the vibrating motor, the vibrating cylinder is mounted at a position of the connection rod out of the sleeve.

By the above technical solution, the vibrating motor, when started, will drive the vibrating cylinder to vibrate under unbalanced centrifugal force. The vibration is transmitted to the two rebars inside the sleeve through the connection rod and in turn to the concrete grout in the whole sleeve, such that the concrete grout in the sleeve squeezes out bubbles under vibration.

Optionally, the connection rod includes a connection section and a detachable section detachably connected with the connection section, the connection section is positioned in the vibrating tube, an end of the connection section away from the detachable section protrudes into the sleeve and is connected with the connection tube, the detachable section is positioned outside the vibrating tube, the vibrator is mounted on the detachable section.

By the above technical solution, the installation of the vibrating assembly is more convenient.

Optionally, a rubber bush is arranged between the connection section and the vibrating tube, such that the connection section is connected with the vibrating tube by the rubber bush in a sealing manner.

By the above technical solution, leakage of the concrete grout through the vibrating tube during the vibrating process is reduced, and the vibration influence on the sleeve is also reduced.

Optionally, the connection tube is configured with internal threads, and each of the connection rebars of at least one of the prefabricated components is configured with external threads adapted to the internal threads.

By the above technical solution, the stability of the connection tube and the connection rebar is improved to a certain extent.

Optionally, a height of an end of the outlet pipe away from the sleeve is higher than a height of an inner cavity of the sleeve.

By the above technical solution, the situation of bubble cavities at the top end of the sleeve due to an unfull injection is reduced.

Optionally, the two ends of the sleeve each are provided with an end cap, the end caps each are sleeved on and screwed to corresponding one of the two ends of the sleeve, and a sealing gasket is arranged between each of the end caps and the sleeve.

By the above technical solution, the corresponding end cap and the sleeve squeeze against each other so that the sealing gasket is deformed to the connection rebar for squeezing, thus improving the sealing between the connection rebar and the sleeve, and reducing the situation that concrete grout flows out.

Optionally, a surface of each of the end caps toward an inner wall of the sleeve is a conical surface, and a surface of the sealing gasket toward a corresponding one of the end caps is a curved surface protruding toward the conical surface.

By the above technical solution, the sealing performance between the two ends of the sleeve and the connection rebar is further improved.

In the other aspect, a sleeve grouting method for prefabricated building is disclosed, including:

- sleeving a connection tube on ends of two connection rebars close to each other, and inserting the two connection rebars into the sleeve from sleeve openings at two ends of the sleeve respectively;
- inserting a connection rod into a vibrating tube, and screwing the connection rod, such that the connection rod is screwed to the connection tube;
- connecting a grout injection equipment to an inlet pipe and injecting grout into the sleeve, until an outlet pipe is filled;
- starting a vibrator after a step of the injecting grout is completed;
- turning on a driver and an oscilloscope after turning off the vibrator, to detect the grout in the sleeve;
- turning off the driver and the oscilloscope and restarting the vibrator when a relative large bubble cavity is present in the grout in the sleeve, afterwards restarting the driver and the oscilloscope after turning off the vibrator, to perform a detection on the grout in the sleeve, until a degree of overlap of the waveform displayed on the oscilloscope with a standard waveform is not less than 80%.

By the above technical solution, not only the dense degree of the grout in the sleeve is detected before solidification of the grout, but also the dense degree of the grout can be adjusted early, to reduce bubble cavities contained in the concrete in the sleeve, to improve the force performance of the connection structure, thus reducing the safety hazards of the spliced building and reducing the reworking of the connection structure.

In summary, at least one of the following beneficial technical effects is realized:

1. Piezoelectric ceramics are arranged at both ends of the sleeve, such that the staff can perform a detection on the concrete grout in the sleeve timely before it is solidified, thereby detecting bubble cavities in the concrete grout timely and making response timely;
2. The vibrating assembly is provided, such that the concrete grout can be vibrated through the connection rebars, to vibrate bubbles in the concrete grout out of the sleeve, thereby improving the fullness of the concrete grout in the sleeve, and thus improving the force performance of the connection structure;
3. End caps are arranged at both ends of the sleeve to seal the inner cavity of the sleeve, such that flow of grout at the ends of the sleeve is reduced.

DESCRIPTION OF THE EMBODIMENTS

The present application is described in further detail hereinafter in combination with the FIGS. 1-2.

In a first aspect, a sleeve grouting device for prefabricated building is provided according to an embodiment of the present disclosure.

Figure 1:
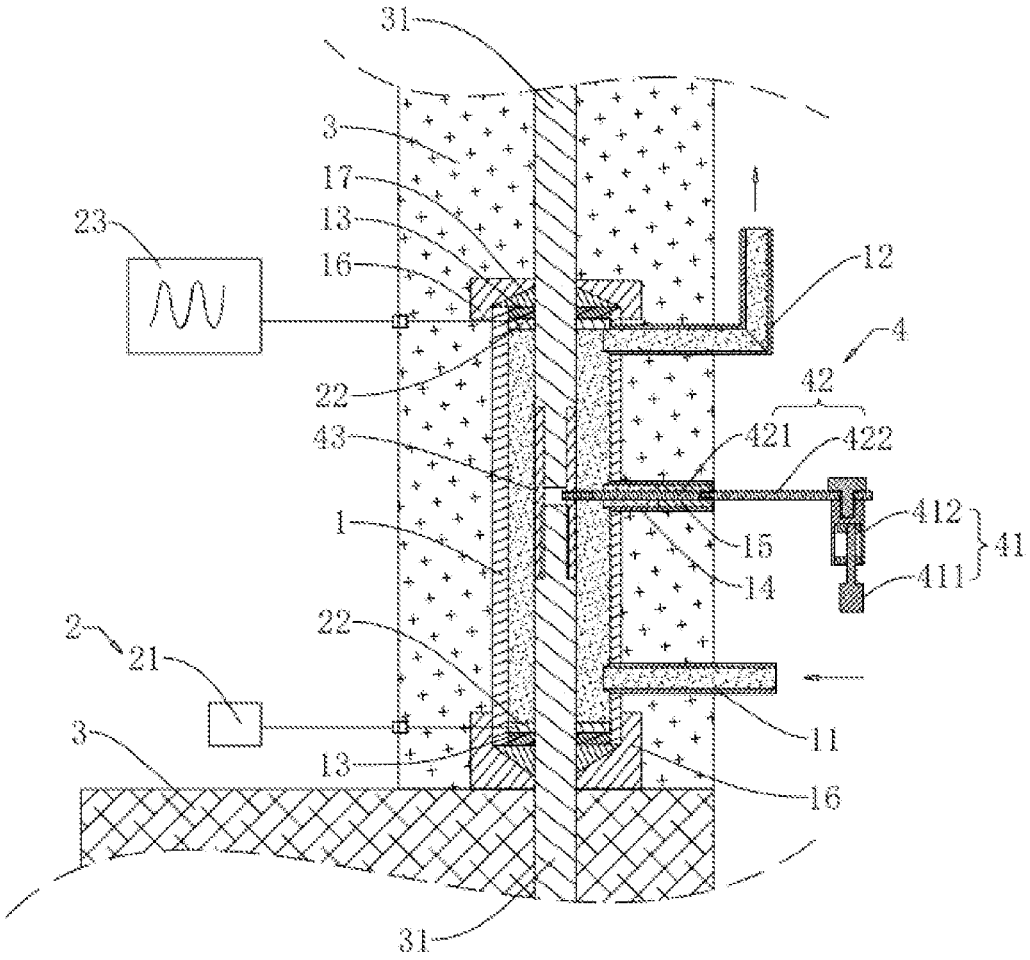
FIG. 1 is a section view of the layout structure of the connection structure of a grouting sleeve according to an embodiment of the present application.

Referring to FIG. 1, in an prefabricated building, a sleeve 1 is usually pre-buried in one of the prefabricated components 3, and then the prefabricated component 3 is lifted and arranged on other prefabricated component 3 together with the sleeve 1, so that the connection rebar 31 of the other prefabricated component 3 is coaxially inserted in the corresponding sleeve 1. Generally, two prefabricated components will be connected to each other by means of horizontal assembly or vertical assembly. Vertical assembly is selected for illustration in the present disclosure.

The grouting device includes a sleeve 1 and a detection assembly 2. The sleeve 1 is configured to be connected with a grout injection equipment, such that concrete grout can be injected into the inner cavity of the sleeve 1 by the grout injection equipment. A plurality of connection rebars 31 protrude from sides of two prefabricated components 3 to be connected facing each other and are corresponding one to one. Two connection rebars 31 corresponding to each other of two different prefabricated components 3 are coaxially inserted in one sleeve 1 from openings at two ends of the sleeve 1 respectively.

The bottom end of the sleeve 1 is horizontally connected with an inlet pipe 11 for entering of the concrete grout into the inner cavity of the sleeve 1, and the top end of the sleeve 1 is horizontally connected with an outlet pipe 12. Both the inlet pipe 11 and the outlet pipe 12 of the sleeve 1 extend up to the surface of the prefabricated component 3, and the outlet end of the grout injection equipment is connected with the inlet pipe 11, and concrete grout is injected into the sleeve 1 by the grout injection equipment through the inlet pipe 11.

The detection assembly 2 includes a driver 21 and an oscilloscope 23, as well as two annular lamellar piezoelectric ceramics 22. The two annular lamellar piezoelectric ceramics 22 are arranged horizontally and are fixed at the top sleeve opening and the bottom sleeve opening of the inner cavity of the sleeve 1. One of the piezoelectric ceramics 22 is electrically connected to the driver 21, and the other of the piezoelectric ceramics 22 is electrically connected to the oscilloscope 23.

Figure 2:
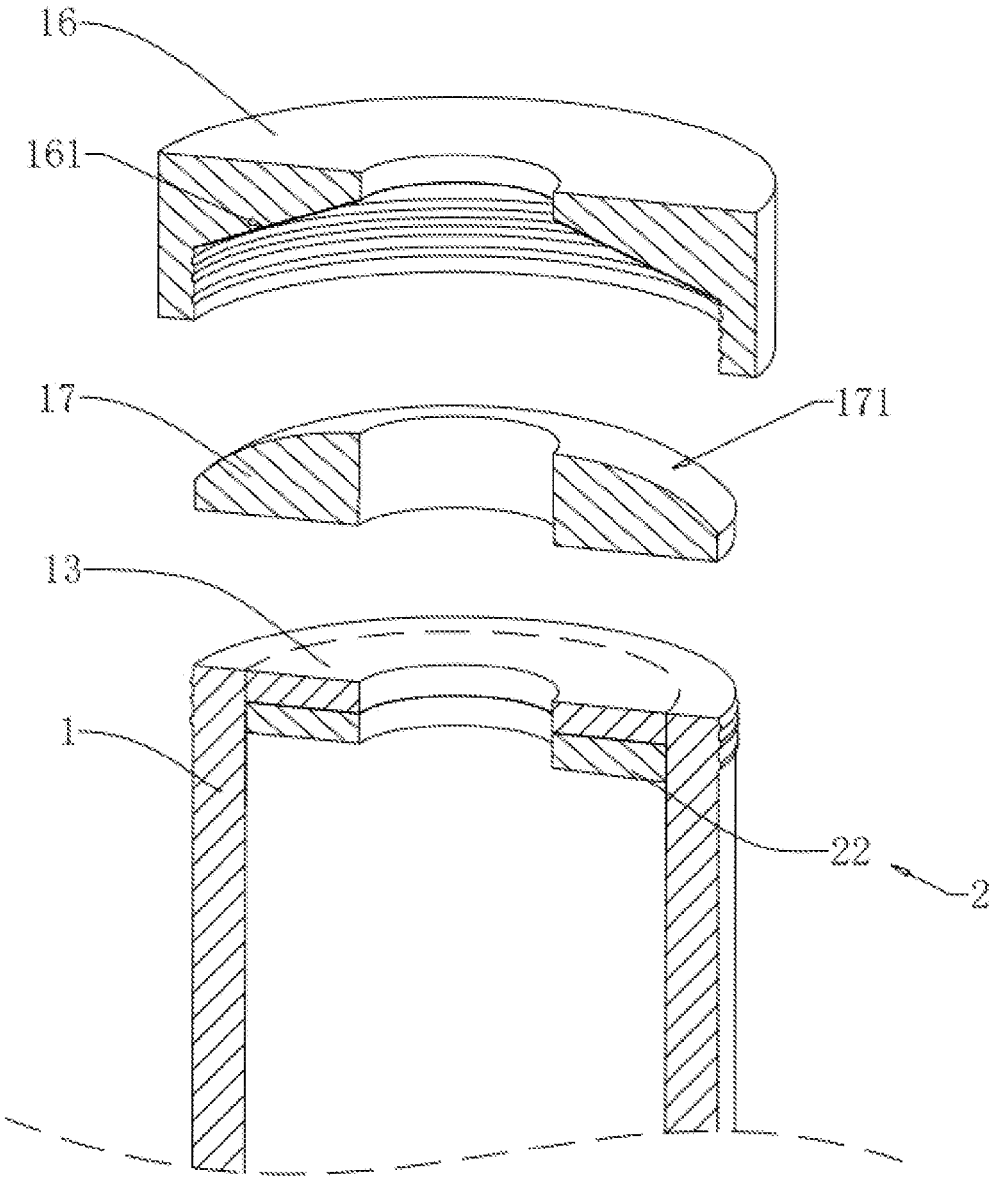
FIG. 2 is a diagram of the mounting structure between the end cap and the sleeve according to an embodiment of the present application.

Referring to FIGS. 1 and 2, in order to avoid damage to the piezoelectric ceramics 22 due to squeezing of the connection rebars 31, inner wall at each of the both ends of the sleeve is coaxially fastened with a limit ring 13, wherein the inner diameter of the limit ring 13 is not smaller than the inner diameter of the piezoelectric ceramics 22. The two limit rings 13 are respectively located at sides of the two piezoelectric ceramics 22 away from each other.

When the sleeve 1 is filled with the concrete grout by the grout injection equipment, the driver 21 is turned on such that the corresponding piezoelectric ceramic 22 generates a signal wave. Then the piezoelectric ceramic 22 at the top end of the sleeve 1 receives the signal wave, which afterwards is displayed on the oscilloscope 23. Specifically, the detection assembly 2 is mainly configured to conduct a non-destructive detection on the inner cavity of the sleeve 1 filled with concrete grout, so as to determine whether there are bubbles in the inner cavity of the grouted sleeve 1 that affect the grouting quality. The driver 21 specifically includes a signal generator and an amplifier. The signal generator can be selected from Tektronix AFG2000 series, and the amplifier can be selected from ATA-2022H high-voltage amplifier. When the sleeve 1 is filled with concrete grout by the grout injection equipment, the driver 21 generates a high-voltage signal wave through the piezoelectric ceramic 22 at the bottom end of the sleeve 1. The high-voltage signal wave is received by the piezoelectric ceramic 22 at the top end of the sleeve 1 after passing through the concrete grout in the sleeve 1 and is transformed to a waveform frame displayed on the oscilloscope 23. The waveform input from the driver 21 is compared with the waveform received by the oscilloscope 23, to determine the dense degree of the concrete grout in the sleeve 1.

The waveform of the concrete grout in a full state in the sleeve 1 is now called as a standard waveform. When a relative large bubble cavity appears in the inner cavity of the sleeve 1, the waveform will change at the surface of the bubble cavity, resulting in a large difference between the standard waveform and the waveform displayed on the oscilloscope 23. The staff can continue to inject concrete grout into the sleeve 1, to squeeze the concrete grout with bubbles from the outlet pipe 12, such that the concrete grout in the sleeve 1 gets denser, and eventually the similarity between the waveform displayed on the oscilloscope 23 and the standard waveform reaches more than 80%.

Referring to FIG. 1, in some embodiments, the height of the end of the outlet pipe 12 away from the sleeve 1 is higher than the height of the inner cavity of the sleeve 1, in order to reduce the occurrence of bubble cavities at the top end of the sleeve 1. Specifically, the outlet pipe 12 as a whole is shaped as an "L", including a horizontal section and a vertical section. The horizontal section is connected to the sleeve 1 at the highest point of the inner cavity of the sleeve 1, and the vertical section is located at the upper side of the end of the horizontal section away from the sleeve 1. At the same time, in order to facilitate the observation of the grout in the outlet pipe 12, both the inlet pipe 11 and the outlet pipe 12 are pipes made of transparent plastic.

Further, the grouting device also includes a vibrating assembly 4. The vibrating assembly 4 includes a vibrator 41, a connection rod 42, and a connection tube 43. The ends of the two connection rebars 31 in the sleeve 1 close to each other both reach into the connection tube 43, wherein one end of the connection rod 42 is screwed to the connection tube 43 in the middle. A vibrating tube is communicated with and horizontally arranged at the sleeve 1 at a position corresponding to the connection tube 43. The end surface of the vibrating tube 14 away from the sleeve 1 is flush with the surface of the prefabricated component 3 at which the sleeve 1 is located. The connection rod 42 extends in the vibrating tube 14 and is slidably connected with the vibrating tube 14. The end of the connection rod 42 protruding out of the sleeve 1 is assembled with the vibrator 41.

Referring to FIG. 1, the vibrator 41 includes a vibrating motor 411 and a vibrating cylinder 412 fixed eccentrically on the output shaft of the vibrating motor 411. The end of the connection rod 42 extending out of the vibrating tube 14 is vertically configured with a connection hole, and the vibrating cylinder 412 is fixedly mounted in the connection hole by bolts.

After the vibrating motor 411 is started, the vibrating motor 411 drives the vibrating cylinder 412 to vibrate. The vibration is transmitted to the two connection rebars 31 inside the sleeve 1 through the connection rod 42 and the connection tube 43, such that the concrete grout in the sleeves following the connection rebars 31 squeezes bubbles out of the inner cavity of the sleeve under vibration, thereby the concrete grout has a denser texture and the full degree of the concrete in the sleeve 1 is improved, thus improving the connection stability of the connection structure.

In order to facilitate the installation of the vibrating assembly 4, the connection rod 42 includes a connection section 421 and a detachable section 422 that are coaxially arranged and screwed to each other. The connection section 421 is located inside the vibrating tube 14, and the end of the connection section 421 away from the detachable section 422 extends into the sleeve 1 and is screwed to the connection tube 43. The detachable section 422 is located outside the vibrating tube 14. The connection hole is defined at the end of the detachable section 422 away from the connection section 421.

Before installing the two prefabricated components 3, the connection tube 43 can be placed in the sleeve 1 and sleeved on the connection rebars 31 inside the sleeve 1 firstly, then the connection tube 43 is passed through the vibrating tube 14 and is screwed into the connection tube 43 to fix the connection tube 43 and the connection rod 42 together, afterwards the upper prefabricated component 3 is lifted and adjusted, so that the connection rebars 31 of the lower prefabricated component 3 can be inserted into the sleeve 1 and the connection tube 43 in turn. Referring to FIG. 1, a rubber bush 15 is coaxially fastened to the inner wall of the vibrating tube 14, and the connection section 421 is connected to the vibrating tube 14 by the rubber bush 15 in a sealing manner, thereby reducing leakage of concrete grout through the vibrating tube 14 during the vibrating process and reducing the influence of the sleeve 1 due to vibration.

One end of the connection tube 43 is configured with internal threads on the inner wall, and the connection rebar 31 of at least one prefabricated component 3 is configured with external threads adapted to the internal threads. In the present disclosure, the two connection rebars 31 are machined. The outer diameter of the connection tube 43 is equal to the outer diameter of the connection rebar 31. The inner wall of one end of the connection tube 43 is configured with internal threads, and the inner wall of the other end is smooth. The way of thread connection can improve stability of the connection rebars 31 and the connection tube 43 to a certain extent, and can stably define the position of the connection tube 43 inside the sleeve 1, to facilitate the corresponding connection of the connection rod 42 and the connection tube 43.

Referring to FIGS. 1 and 2, the top end and the bottom end of the sleeve 1 are each provided with an end cap 16, and the end cap 16 is configured with a throughhole to be passed through by the connection rebar 31, wherein the throughhole is coaxial with the sleeve 1. The end cap 16 is configured with internal threads at the inner circumference wall, and the end cap 16 is sleeved on the corresponding end of the sleeve 1 and is screwed to the sleeve 1. An annular sealing gasket 17 is filled between the end cap 16 and the sleeve 1. The inner wall of the sealing gasket 17 is closely fitted to the connection rebar 31 through the end cap 16.

Further, the inner wall surface of the end cap 16 toward the sleeve 1 is a conical surface 161, and the surface of the sealing gasket 17 toward the end cap 16 is a curved surface 171 protruding toward the conical surface 161, so that the sealing gasket 17 can have a larger deformation allowance when the end cap 16 and the sleeve 1 squeeze against each other, thereby improving the sealing effect between the connection rebar 31 and the sleeve 1.

In the other aspect, a sleeve grouting method for prefabricated building is disclosed, including:

sleeving the connection tube 43 on the ends of the two connection rebars 31 close to each other, lifting and assembling two prefabricated components 3 so that two connection rebars 31 corresponding to each other reach into the sleeve 1 from the top sleeve opening and the bottom sleeve opening at two ends of the sleeve 1 respectively;

inserting the connection rod 42 in the vibrating tube 14 and screwing the connection rod 42, such that the connection rod 42 is screwed to the connection tube 43;

screwing the end caps 16 of the sleeve 1 to seal the ends of sleeve 1;

connecting the grout injection equipment to the inlet pipe 11 and injecting concrete grout into the sleeve 1 until the outlet pipe 12 is filled;

after the injection is completed, starting the vibrator 41 so that the vibrator 41 drives the connection rod 42 to vibrate in the vibrating tube 14;

turning on the driver 21 and the oscilloscope 23 after turning off the vibrator 41, to detect grout in the sleeve 1;

during the detection process, when there is a relative large bubble cavity in the grout in the sleeve 1, turning off the driver 21 and the oscilloscope 23 and restarting the vibrator 41, afterwards restarting the driver 21 and the oscilloscope 23 after turning off the vibrator 41 to detect the grout in the sleeve 1, until a degree of overlap of the waveform displayed on the oscilloscope 23 with the standard waveform is not less than 80%;

removing the grout injection equipment and plugging the inlet pipe 11 and the outlet pipe 12, afterwards removing the vibrator 41 together with the detachable section 422, and waiting for solidification of the concrete grout after disconnecting the driver 21 and the oscilloscope 23.

Finally, the parts of the inlet pipe 11 and the outlet pipe 12 protruding from the surface of the prefabricated component 3 is cleaned uniformly, to ensure the flatness of the building surface.

By using the above-mentioned sleeve grouting method, not only the dense degree of the grout in the sleeve 1 can be monitored in real time, but also the dense degree of the grout can be adjusted early, to reduce bubble cavities contained in the concrete in the sleeve 1, which improves the force performance of the connection structure and reduces the safety hazards of the spliced building.

The above are the preferred embodiments of this application, which are not to limit the protection scope of this application. Therefore, all equivalent changes made according to the structure, shape and principle of this application should be covered by the protection scope of this application.

LIST OF SIGNS

1. sleeve; 11. inlet pipe; 12. outlet pipe; 13. limit ring; 14. vibrating tube; 15. rubber bush; 16. end cap; 161. conical surface; 17. sealing gasket; 171. curved surface; 2. detection assembly; 21. driver; 22. piezoelectric ceramic; 23. oscilloscope; 3. prefabricated component; 31. connection rebar; 4. vibrating assembly; 41. vibrator; 411. vibrating motor; 412. vibrating cylinder; 42. connection rod; 421. connection section; 422. detachable section; 43. connection tube.

What is claimed is:

1. A sleeve grouting device for prefabricated building, comprising: a sleeve, a driver and an oscilloscope, wherein sleeve openings at two ends of the sleeve each are configured to be penetrated by connection rebars of each of two different prefabricated components, a piezoelectric ceramic is provided horizontally at each of the sleeve openings at the two ends of the sleeve, one of the piezoelectric ceramics is electrically connected to the driver and another of the piezoelectric ceramics is electrically connected to the oscilloscope;

a bottom end of the sleeve is connected to an inlet pipe that is in communication with grout injection equipment, and a top end of the sleeve is connected to an outlet pipe;

the sleeve grouting device for prefabricated building further comprises a vibrating assembly, wherein the vibrating assembly comprises: a vibrator, a connection rod, and a connection tube, ends of the connection rebars close to each other are slidably connected in the connection tube, a vibrating tube is connected to the sleeve at a position of the sleeve corresponding to the connection tube, the connection tube is slidably connected in the vibrating tube, an end of the connection rod protrudes in the sleeve and is connected with the connection tube, and an end of the connection tube outside the sleeve is connected with the vibrator.

2. The sleeve grouting device for prefabricated building according to claim 1, wherein the vibrator comprises a vibrating motor and a vibrating cylinder eccentrically fixed on an output shaft of the vibrating motor, the vibrating cylinder is mounted at a position of the connection rod out of the sleeve.

3. The sleeve grouting device for prefabricated building according to claim 1, wherein the connection rod comprises a connection section and a detachable section detachably connected with the connection section, the connection section is positioned in the vibrating tube, an end of the connection section away from the detachable section protrudes into the sleeve and is connected with the connection tube, the detachable section is positioned outside the vibrating tube, and the vibrator is mounted on the detachable section.

4. The sleeve grouting device for prefabricated building according to claim 3, wherein a rubber bush is arranged between the connection section and the vibrating tube, such that the connection section is connected with the vibrating tube by the rubber bush in a sealing manner.

5. The sleeve grouting device for prefabricated building according to claim 1, wherein the connection tube is configured with internal threads, and each of the connection rebars of at least one of the two different prefabricated components is configured with external threads adapted to the internal threads.

6. The sleeve grouting device for prefabricated building according to claim 1, wherein a height of an end of the outlet pipe away from the sleeve is higher than a height of an inner cavity of the sleeve.

7. The sleeve grouting device for prefabricated building according to claim 1, wherein the two ends of the sleeve each are provided with an end cap, the end caps each are sleeved on and screwed to a corresponding one of the two ends of the sleeve, and a sealing gasket is arranged between each of the end caps and the sleeve.

8. The sleeve grouting device for prefabricated building according to claim 7, wherein a surface of each of the end caps toward an inner wall of the sleeve is a conical surface, and a surface of the sealing gasket toward a corresponding one of the end caps is a curved surface protruding toward the conical surface.

* * * * *